US007572566B2

(12) United States Patent
Shibai et al.

(10) Patent No.: US 7,572,566 B2
(45) Date of Patent: Aug. 11, 2009

(54) TONER FOR DEVELOPMENT AND METHOD OF PRODUCING TONER

(75) Inventors: Yasuhiro Shibai, Yamatokoriyama (JP); Katsuru Matsumoto, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 421 days.

(21) Appl. No.: 11/489,515

(22) Filed: Jul. 20, 2006

(65) Prior Publication Data

US 2007/0042283 A1 Feb. 22, 2007

(30) Foreign Application Priority Data

Aug. 3, 2005 (JP) ..... 2005-225850

(51) Int. Cl.
*G03G 9/08* (2006.01)

(52) U.S. Cl. ..... 430/137.1; 430/137.15; 430/137.19

(58) Field of Classification Search ..... 430/137.1, 430/137.15, 137.19

See application file for complete search history.

(56) References Cited

U.S. PATENT DOCUMENTS

2004/0229147 A1* 11/2004 Higuchi et al. ..... 430/110.3

FOREIGN PATENT DOCUMENTS

JP 2003-5443 1/2003

* cited by examiner

*Primary Examiner*—Hoa V Le
(74) *Attorney, Agent, or Firm*—Nixon & Vanderhye P.C.

(57) ABSTRACT

According to the method of producing toner, toner is produced by (i) forming particles of a pigmented resin by applying shear stress to a mixture of a pigmented resin composition, an organic solvent, a polymer dispersing agent, and a hydrophobic medium, the organic solvent being capable of reducing viscosity of the pigmented resin composition, and said polymer dispersing agent having a glass transition point in a range of 50° C. to 80° C. and an SP value in a range of 8.5 to 10, (ii) distilling off the organic solvent, and (iii) separating the toner from the hydrophobic medium and drying the toner. With the above arrangement, the method makes it possible to (i) easily downsize toner particle without causing thermal decomposition of a resin or separation of a release agent, and (ii) produce toner that is small in particle size, excellent in humidity-resistance, and less likely to aggregate.

9 Claims, 1 Drawing Sheet

TONER FOR DEVELOPMENT AND METHOD OF PRODUCING TONER

This Nonprovisional application claims priority under 35 U.S.C. § 119(a) on Patent Application No. 225850/2005 filed in Japan on Aug. 3, 2005, the entire contents of which are hereby incorporated by reference.

FIELD OF THE INVENTION

The present invention relates to a method of producing toner for development with the use of an elcctrophotographic image forming apparatus.

BACKGROUND OF THE INVENTION

There are two types of methods of producing toner for development used by an electrophotographic image forming apparatus. Specifically, used as such two types of methods are (i) a dry method in which no aqueous medium is used, and (ii) a wet method in which an aqueous medium is used. In general, the dry method indicates a pulverization method, including the steps of (i) mixing a powdery binder resin, a coloring agent, a charge control agent, and a wax, by using a wind-power mixer such as a Henschel mixer, (ii) kneading thus obtained powdery mixture, by using a device such as a twin-screw kneader, (iii) cooling the mixture, and (iv) pulverizing thus obtained solid material of resin by using a mill such as a jet mill, until the solid material of resin is pulverized into several microns.

Exemplary wet methods include suspension polymerization, and emulsion polymerization in combination with aggregation. An exemplary known process of the suspension polymerization is that including the steps of (i) dispersing, in water, a vinyl monomer, which is a raw material of a binder resin, a polymerization initiator, a coloring agent, a charge control agent, a release agent and the like, together with a dispersing agent by using a stirrer such as a homogenizer, and then (ii) performing suspension polymerization, thereby forming toner particles. On the other hand, an exemplary known process of the emulsion polymerization in combination with aggregation is that including the steps of (i) performing emulsion polymerization by using a vinyl monomer, which is a raw material of a binder resin, and (ii) aggregating thus obtained resin dispersion with an aqueous dispersion of coloring agent, an aqueous dispersion of charge control agent, and an aqueous dispersion of wax, thereby forming toner particles.

Meanwhile, in recent years, there has been an increasing demand for an electrophotographic apparatus to be able to produce a color image which is equivalent in quality to a gravure or a photographic picture, as color printing with the use of an electrophotographic image forming apparatus has become developed. Achieving high image quality requires a development technique that realizes high dot-reproducibility without causing unevenness of colors or graininess, as well as a high-resolution scanner and a high image quality image-processing technique. To fulfill the requirement, downsizing of toner particle becomes an important problem to be solved.

In view of downsizing of toner particle, the pulverization requires a longer time and greater energy for pulverizing to produce toner with a small particle size, and therefore has problems that (i) an amount of produced toner decreases and (ii) cost of producing toner increases. Furthermore, a number of contaminating free waxes and contaminating free charge control agents increases, which free waxes and free charge control agents are generated in the step of pulverizing. This has a tendency to often cause a formation of a film on a carrier or a photoreceptor. This makes it difficult to produce toner with a volume average particle diameter of 6 μm or smaller.

On the other hand, the polymerization allows microscopic toner particles to be directly produced in an aqueous medium, and is thus considered as a more suitable technique for producing toner with a smaller particle size than the pulverization. However, suspension polymerization and emulsion polymerization require to use a dispersing agent (surfactant) to disperse a monomer or a particulate resin in an aqueous medium. This causes a highly hydrophilic dispersing agent (surfactant) to remain on a surface of toner. As a result, a property of toner such as an amount of charges or an electric resistance changes in accordance with a change in humidity. Therefore, the polymerization has a problem that stability (humidity-resistance) to condition of humidity decreases.

The highly hydrophilic dispersing agent can be removed to some extent by washing the surface of toner with the use of an enormous amount of pure water. This, however, gives rise to a problem of increasing costs of production and processing waste water. Furthermore, it is impossible to remove a dispersing agent (surfactant) remained in the toner particles. This results in that the amount of absorbed water caused by the residual dispersing agent (surfactant) in the toner (circumference) changes depending upon the degree of dryness of the toner, thereby causing an amount of charges and an electric resistance of the toner to be unstable.

In view of the problems, there is suggested a method of producing toner without using a highly-hydrophilic dispersing agent (surfactant) in Patent Document 1 (Japanese Unexamined Patent Publication No. 2001-356528 (published on Dec. 26, 2001)).

According to the method of Patent Document 1, toner is produced by (i) applying shear stress, in a hydrophobic organic medium to which the resin component is insoluble, to (a) a pigmented resin composition including a resin, a coloring agent, and a charge control agent, and (b) a copolymer of polyvinylpyrrolidone and eicosyne (polymer dispersing agent) so that the composition becomes particles to form toner particles, and then (ii) separating the toner particle from the organic medium.

The method of Patent Document 1 does not require to use a highly-hydrophilic dispersing agent, and therefore can efficiently produce toner that is small in particle size and excellent in humidity-resistance.

However, the resin needs to be heated to a temperature equal to or above a softening point of the resin, in order for the resin composition to become particles. Therefore, there is a problem that, if a resin with a greater molecular weight and a higher softening point is used in order to improve offset resistance, the resin, the additive, and/or other components may be thermally decomposed while they are heated. Furthermore, the method disclosed in Patent Document 1 has at least the following difficulty in handling the resin in light of production. Specifically, if the softening point of the resin is higher than the boiling point of the hydrophobic organic solvent, then pressure needs to be applied to a device for causing the resin composition to become particles.

In view of the problems, Patent Document 2 (Japanese Unexamined Patent Publication No. 2003-5443 (published on Jan. 8, 2003)) suggests a method of producing toner for realizing particles under a relatively low temperature.

According to the method of Document 2, toner is produced by (i) applying shear stress, in a hydrophobic organic medium to which the resin content is insoluble, to (a) a pigmented resin composition including a resin, an organic solvent, a coloring agent, and a charge control agent, and (b) a copolymer of polyvinylpyrrolidone and eicosyne so that the composition becomes particles to form toner particles, (ii) distilling off the organic solvent, and then (iii) separating the toner particle from the organic medium.

As described above, the dry method has a problem that it is difficult to further reduce the particle size of toner, whereas the wet method still has a problem of humidity-resistance, although the wet method can produce a smaller-sized toner than the dry method can.

In order to solve the above problems, Patent Documents 1 and 2 suggest adopting a method for producing toner that is excellent in humidity-resistance, in which method a pigmented resin composition is made to be particles in a hydrophobic medium with the use of a copolymer of polyvinylpyrrolidone and eicosyne, which copolymer acts as a dispersing agent. However, the toner of Documents 1 and 2 has a problem in that a surface of the toner becomes more adhesive due to a residual dispersing agent on the surface of the toner. This causes a tendency of toner aggregation.

SUMMARY OF THE INVENTION

The present invention is in view of solving the above problems of the conventional techniques, and has as an object to provide a method of producing toner, which method makes it possible to (i) easily downsize toner particle without causing thermal decomposition of a resin or separation of a release agent, and (ii) produce toner that is small in particle size, excellent in humidity-resistance, and less likely to aggregate.

In order to solve the above problems, a method of producing toner according to the present invention is arranged so that the method includes the steps of: (i) forming particles of a pigmented resin by applying shear stress to a mixture of a pigmented resin composition, an organic solvent, a polymer dispersing agent, and a hydrophobic medium, the organic solvent being capable of reducing viscosity of the pigmented resin composition, and said polymer dispersing agent having a glass transition point in a range of 50° C. to 80° C. and an SP value in a range of 8.5 to 10; and (ii) distilling off the organic solvent.

With the above arrangement, the method makes it possible to (i) easily downsize toner particle without causing thermal decomposition of a resin or separation of a release agent, and (ii) produce toner that is small in particle size, excellent in humidity-resistance, and less likely to aggregate.

DESCRIPTION OF THE EMBODIMENTS

Figure 1:
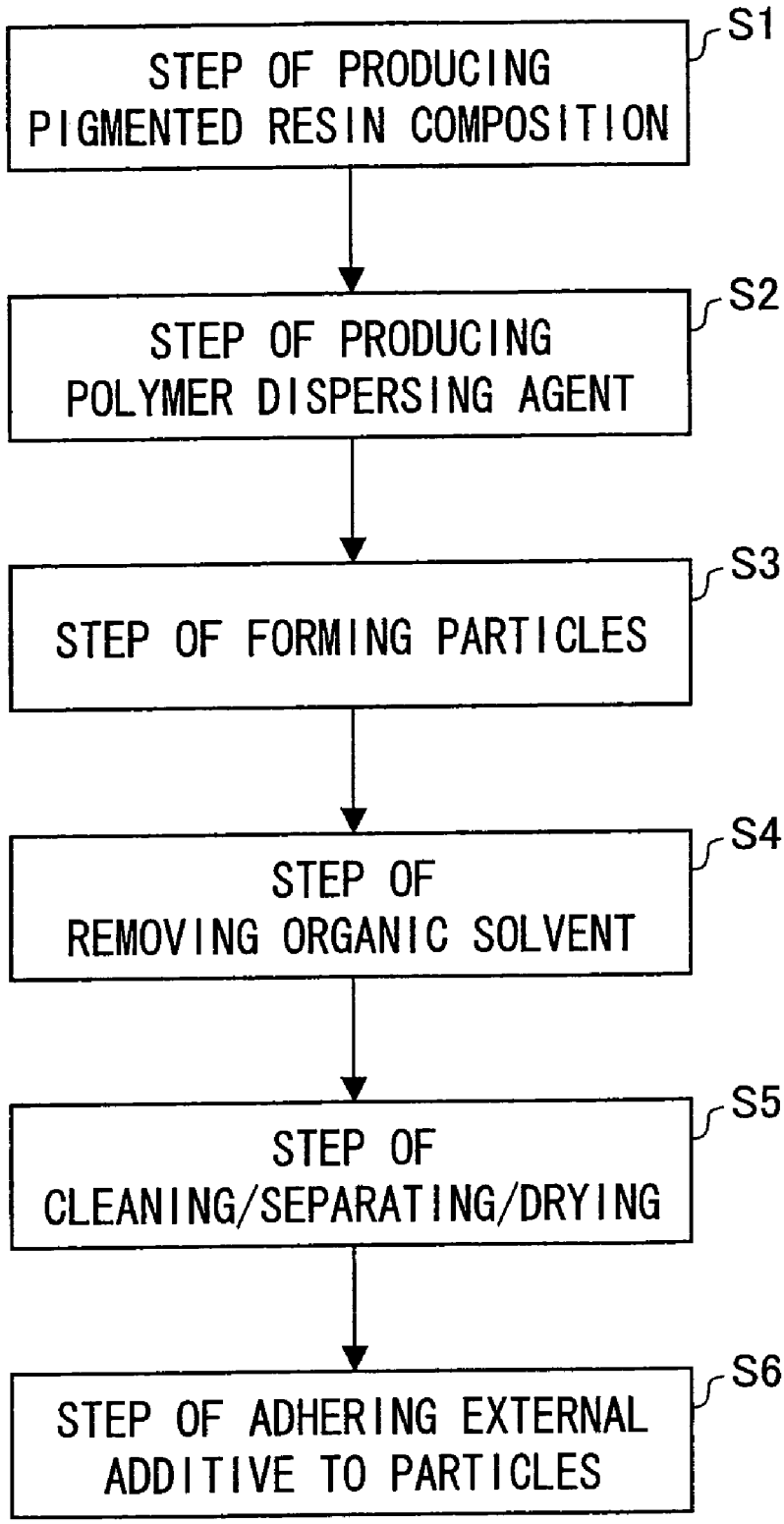
FIG. 1 is a process chart illustrating steps of an exemplary method of producing toner according to the present invention.

The following describes a method of producing toner according to the present invention. The method makes it possible to (i) easily downsize toner particle and (ii) produce toner that is excellent in humidity-resistance, and less likely to aggregate with other toner. Specifically, according to the method, the toner is produced by: (i) applying shear stress to a mixture of an organic solvent and a pigmented resin composition in a hydrophobic medium, in a presence of a polymer dispersing agent, so that the pigmented resin composition is made to be particles, the polymer dispersing agent having a glass transition point in a range of 50° C. to 80° C. and an SP (solubility parameter) value in a range of 8.5 to 10, and then (ii) distilling off the organic solvent.

The following describes an exemplary method of producing toner according to the present invention, with reference to FIG. 1. Note that the method described with reference to FIG. 1 is merely an example, and the present embodiment should not be limited to the method described below.

In the step of producing a pigmented resin composition (S1) in FIG. 1, the followings are mixed by using a wind-power mixer such as a Henschel mixer: a binder resin, which is a raw material of toner; a coloring agent; a release agent, when necessary; and a charge control agent, when necessary. Then, the resultant mixture is kneaded by using a melt-kneader such as a twin-screw kneader. As a result, a pigmented resin composition is produced.

Then, in the step of producing a polymer dispersing agent (S2), a polymer dispersing agent is produced that has a glass transition point in a range of 50° C. to 80° C. and an SP value in a range of 8.5 to 10.

This is followed by the step of comminuting (S3). In step S3, (a) the pigmented resin composition prepared in step S1, (b) an organic solvent that can reduce a viscosity of the pigmented resin composition, and (c) a polymer dispersing agent prepared in step S2 are added to a hydrophobic medium, and then heated while being stirred. The stirring causes a shear stress to be applied so that the pigmented resin composition is made to be particles. The pigmented resin composition is made to be particles by using a device such as a T.K. HOMOMIXER (manufactured by Tokushukika kogyo) and a Clearmix (manufactured by M-technique).

In the step of removing an organic solvent (S4), the organic solvent is removed from a dispersion thus prepared in step S3. This allows a dispersion of pigmented resin particles (toner) to be prepared with no organic solvent content.

In the step of cleaning, separating, and drying (S5), the toner prepared in step S4 is cleaned, separated, and dried. Note that the drying in step S5 refers to evaporation of a hydrophobic medium adhering to a surface of the toner.

Upon completion of step S5, toner with a polymer dispersing agent adhering to a surface of the toner is prepared, which polymer dispersing agent has (i) a glass transition point in a range of 50° C. to 80° C. and (ii) an SP value in a range of 8.5 to 10.

After the foregoing steps, a step of adhering an external additive to the particles is carried out when necessary. In the step of adhering an external additive to the particles (S6), the toner prepared in step S5 and an external additive are mixed by using a wind-power mixer such as a Henschel mixer. This allows production of toner with the external additive adhering to the toner.

The foregoing described how to produce toner according to the present invention, with reference to FIG. 1. The following describes materials used for producing the toner.

<Pigmented Resin Composition>

The method of producing toner according to the present invention uses a pigmented resin composition that is obtained by melting and kneading a binder resin and a coloring agent, a release agent when necessary, a charge control agent when necessary, and/or the like, with the use of a device such as a twin-screw kneader and an open roller. Alternative pigmented resin composition is that produced by performing suspension polymerization with the use of (i) a monomer formed in an aqueous medium and (ii) an oil droplet containing a coloring agent or the like. Another alternative pigmented resin composition is that produced by aggregation and association in an aqueous medium with the use of a particulate resin produced by emulsion polymerization, a particulate coloring agent, or the like.

The method of producing a pigmented resin composition is not limited to a specific one. In light of high degree of freedom with regard to the selection of a binder resin, a pigmented resin composition is suitable which is prepared, for example, by melting and kneading with the use of a device such as a twin-screw kneader and an open roller.

The following specifically describes a binder resin, a coloring agent, a polymer dispersing agent, a hydrophobic solvent and the like that are used for producing a pigmented resin particle (toner).

<Binder Resin>

The binder resin that can be used as a component of the pigmented resin composition is not limited to a specific one. For example, a polyester based resin or styrene based resin that has a glass transition point in a range of 50° C. to 70° C. may be used as the resin for toner.

The polyester resin may be obtained by polycondensation with the use of (i) a polyhydric alcohol, (ii) a multivalent carboxylic acid, and (iii) a multivalent carboxylic acid monomer that has a sulfonate as a side chain, or a polyhydric alcohol monomer that has a sulfonate as a side chain. Alternatively, the polyester resin may be obtained by polycondensation with the use of (i) a multivalent carboxylic acid monomer and (ii) a polyhydric alcohol monomer.

Examples of the multivalent carboxylic acid include: aromatic dicarboxylic acids such as terephthalic acid, isophthalic acid, orthophthalic acid, 1,5-naphthalenedicarboxylic acid, 2,6-naphthalenedicarboxylic acid, anthracenedipropionic acid, anthracenedicarboxylic acid, diphenic acid, sulfoterephthalic acid, 5-sulfoisophthalic acid, 4-sulfophthalic acid, 4-sulfonaphthalene2,7 dicarboxylic acid, 5(4-sulfophenoxyl)isophthalic acid, and sulfoterephthalic acid, and metal salts and ammonium salt thereof; aliphatic dicarboxylic acid such as succinic acid, adipic acid, azelaic acid, sebacic acid, and dodecanedicarboxylic acid; aliphatic unsaturated multivalent carboxylic acid such as fumaric acid, maleic acid, itaconic acid, mesaconic acid, and citraconic acid; aromatic unsaturated multivalent carboxylic acid such as phenylenediacrylic acid; alicyclic dicarboxylic acid such as hexahydrophthalic acid and tetrahydrophthalic acid; multivalent carboxylic acid with trivalence or greater valences such as trimellitic acid, trimesic acid, and pyromellitic acid. Further, the acid content may be multivalent carboxylic acids containing monocarboxylic acids.

It is preferable that the monocarboxylic acids be aromatic monocarboxylic acids. Examples of the aromatic monocarboxylic acids include: benzoic acid, chlorobenzoic acid, bromobenzoic acid, parahydroxybenzoic acid, naphthalenecarboxylic acid, anthracenecarboxylic acid, 4-methylbenzoic acid, 3-methylbenzoic acid, salicylic acid, thiosalicylic acid, phenylacetic acid, their lower alkylester, sulfobenzoic acid monoammonium salt, sulfobenzoic acid monosodium salt, cyclohexylaminocarbonylbenzoic acid, n-dodecylaminocarbonylbenzoic acid, tert-butylbenzoic acid and tert-butylnaphthalenecarboxylic acid.

Examples of the polyhydric alcohols include aliphatic polyhydric alcohols, alicyclic polyhydric alcohols, and aromatic polyhydric alcohols.

Examples of the aliphatic polyhydric alcohols include: aliphatic diols such as ethylene glycol, propylene glycol, 1,3-propanediol, 2,3-butanediol, 1,4-butanediol, 1,5-pentanediol, 1,6-hexanediol, neopentylglycol, diethylene glycol, dipropylene glycol, 2,2,4-trimethyl1,3-pentanediol, polyethylene glycol, polypropylene glycol, and polytetramethyleneglycol; triols such as trimethylolethane, trimethylolpropane, glycerin, and pentaL-threitol; and tetraols.

Examples of the alicyclic polyhydric alcohols include 1,4-cyclohexanediol, 1,4-cyclohexanedimethanol, spiroglycol, hydrogenated bisphenol A, ethylene oxide adduct of hydrogenated bisphenol A, propylene oxide adduct of hydrogenated bisphenol A, tricyclodecanediol, and tricyclodecanedimethanol.

Examples of the aromatic polyhydric alcohols include paraxyleneglycol, metaxyleneglycol, orthoxyleneglycol, 1,4-phenyleneglycol, ethylene oxide adduct of 1,4-phenyleneglycol, bisphenol A, an ethylene oxide adduct of bisphenol A, and an propylene oxide adduct of bisphenol A.

Further, a polyhydric alcohol containing a monoalcohol may be used as the alcohol content. Examples of the monoalcohol include aliphatic alcohols, aromatic alcohols, and alicyclic alcohols.

The styrene based resin is obtained by copolymerization of (i) styrene or styrene derivative monomer and (ii) acrylic acid, methacrylic acid, or a derivative monomer thereof.

For example, the followings may be used as the monomer: styrene, vinyl toluene, methyl acrylate, ethyl acrylate, isopropyl acrylate, n-butyl acrylate, isobutyl acrylate, ethylhexyl acrylate, methyl methacrylate, ethyl methacrylate, isopropyl methacrylate, n-butyl methacrylate, isobutyl methacrylate, and ethylhexyl methacrylate.

<Coloring Agent>

A well-known coloring agent such as a pigment or dye of yellow, cyan, magenta, black or the like may be used as the coloring agent.

Examples of coloring agent of yellow toner include C. I. Pigment Yellow 1, 3, 4, 5, 6, 12, 13, 14, 15, 16, 17, 18, 24, 55, 65, 73, 74, 81, 83, 87, 93, 94, 95, 97, 98, 100, 10.1, 104, 108, 109, 110, 113, 116, 117, 120, 123, 128, 129, 133, 138, 139, 147, 151, 153, 154, 155, 156, 168, 169, 170, 171, 172, 173, 180, 185, particularly, C. I. Pigment Yellow 17 (dis azo), 74 (mono azo), 155 (condensed azo), 180 (benzimidazolone).

Examples of coloring agent of magenta toner include C. I. Pigment Red 1, 2, 3, 4, 5, 6, 7, 8, 9, 10, 12, 14, 15, 17, 18, 22, 23, 31, 37, 38, 41, 42, 48: 1, 48: 2, 48: 3, 48: 4, 49: 1, 49: 2, 50: 1,52: 1,52: 2, 53: 1,53: 3, 54, 57: 1,58: 4, 60: 1, 63: 1, 63: 2,64: 1, 65, 66, 67, 68, 81, 83, 88, 90, 90: 1, 112, 114, 115, 122, 123, 133, 144, 146, 147, :149, 150, 151, 166, 168, 170, 171, 172, 174, 175, 176, 177, 178, 179, 185, 187, 188, 189, 190, 193, 194, 202, 208, 209, 214, 216, 220, 221, 224, 242, 243, 243: 1,245, 246, 247, particularly, C. I. Pigment Red 48: 1 (barium red), 48: 2 (calcium red), 48: 3 (strontium red), 48: 4 (manganese red), 53: 1 (lake red), 57: 1 (brilliant carmine), 122 (quinacridone magenta), and 209 (dichloroquinacridone red).

Examples of coloring agent of cyan toner include phthalocyanine base C. I. Pigment Blue 1, 2, 15: 1, 15: 2, 15: 3, 15: 4, 15: 6, 15, 16, 17: 1, 27, 28, 29, 56, 60, 63, particularly, C. I. Pigment Blue 15: 3 (phthalocyanine blue G), 15 (phthalocyanine blue R), 16 (metal-free phthalocyanine blue), 60 (indanthrone blue).

A carbon black prepared by various methods may be used as the coloring agent for black toner.

One kind of coloring agent may be used alone. Alternatively, two or more kinds of coloring agents may be used in combination. In the case where two or more kinds of coloring agents are used in combination, it is possible to use (i) a combination of coloring agents of similar colors or (ii) a combination of coloring agents of plural dissimilar colors. The amount of coloring agent content may be selected from a wide range in accordance with toner properties, but it is preferable that the amount of coloring agent content be in a range of 0.1 wt % to 20 wt % for 100 wt % of resin, and more preferably, in a range of 0.1 wt % to 15 wt % for 100 wt % of resin. If the amount of coloring agent content is less than 0.1 wt %, then it becomes difficult to achieve sufficient image density. On the other hand, if the amount of coloring agent content is greater than 20 wt %, then the coloring agents easily aggregate in a formed image.

In order to obtain toner that is excellent in transparency and in color reproducibility, it is preferable that the number average particle diameter of the coloring agent dispersed in the resin be 0.3 μm or below.

<Release Agent>

In the present invention, a release agent may be added to a pigmented resin composition when necessary. Inclusion of a release agent in toner prevents the toner from adhering to a fixing roller in a fixing process.

A well known agent may be used as the release agent. Examples thereof include: petroleum based wax such as paraffin wax and microcrystalline wax; wax of plant origin such as carnauba wax, rice wax, candelilla wax, and Japan wax; wax of animal origin such as beeswax and spermaceti; wax of mineral origin such as montan wax and ozokerite; aliphatic synthetic wax such as fatty acid amid, phenol aliphatic ester; hydrocarbon based synthesis wax such as a low molecular weight polypropylene wax, a low molecular weight polyethylene wax, and Fischer-Tropsch wax; alcoholic synthesis wax; and ester synthesis wax. The release agent may be used alone or in combination.

In order to obtain toner that is excellent in transparency and in color reproducibility, it is preferable that the number average particle diameter of the release agent be dispersed in the resin be 0.3 μm or below.

<Charge Control Agent>

In the present invention, a charge control agent may be added to a pigmented resin composition when necessary. Inclusion of a charge control agent in toner improves an electrostatic charging property of the toner, and allows the toner to maintain a certain amount of charges for a long period of time.

For example an organic compound containing a basic nitrogen atom may be used as the charge control agent for controlling positive charge. Examples of the organic compound include basic dye, quaternary ammonium salt, aminopyrine, pyrimidine compound, polynuclear polyamino compound, amino silanes, nigrosine, and imidazole.

Examples of the charge control agent for controlling negative charge include: oil-soluble dyes such as oil black and spirone black; azo dye containing metals; boron compounds; metal salts of naphthenic acid; metal salts of alkylsalicylic acid; fatty acid soaps; and resin acid soaps.

The charge control agent is added in a range of 0.1 parts by weight to 10 parts by weight for 100 parts by weight of the binder resin, but a preferable range of the amount of the charge control agent is from 0.5 parts by weight to 5 parts by weight.

In order to obtain toner that is excellent in transparency and in color reproducibility, it is preferable that the number average particle diameter of the charge control agent dispersed in the binder resin be 0.3 μm or less.

<Organic Solvent>

In the present invention, an organic solvent is used so as to reduce viscosity of the pigmented resin composition. A suitable organic solvent is an organic solvent that can dissolve or swell the binder resin contained in the pigmented resin composition. In addition, it is preferable that a boiling point of the organic solvent be lower than a boiling point of the hydrophobic medium because the organic solvent needs to be distilled off in the hydrophobic medium after the step of forming particles.

Concrete examples of organic solvent include diethylether, THF, acetone, methylethylketone, isopropyl alcohol, and ethanol.

By using such an organic solvent together with the pigmented resin composition, it is possible to perform the particles formation at a lower temperature, compared to a case where no organic solvent is used. This makes it possible to produce toner without causing thermal decomposition of a resin even if a resin with a greater molecular weight and a higher softening point is used, and therefore the toner thus obtained is excellent in offset resistance property.

In the case where a release agent is added to the pigmented resin composition, if particles are prepared at a higher temperature than the melting point of the release agent, a phenomenon (bleeding) may occur in which the release agent separates from the pigmented resin composition. In this case, it is possible to avoid such bleeding by adopting a method in which an amount of the organic solvent to be added is added so that the temperature, at which the particles are prepared, is lower than the melting point of the release agent.

<Polymer Dispersing Agent>

In the method of producing toner according to the present invention, a polymer dispersing agent with a glass transition point in the range of 50° C. to 80° C. and an SP value in the range of 8.5 to 10 is used in the step of forming particles from the pigmented resin composition while the shear stress is applied to the pigmented resin composition in the hydrophobic medium. By using the polymer dispersing agent, it becomes easy to efficiently produce toner that is small in particle size, excellent in humidity-resistance, and less likely to aggregate with other toner.

If a greater amount of polymer dispersing agent is added, then toner which has been made to be particles tends to have a smaller particle diameter. On the other hand, if a less amount of polymer dispersing agent is added, then toner which has been made to be particles tends to have a greater particle diameter. Therefore, it is preferable to suitably prepare the toner depending upon a target particle size.

The polymer dispersing agent, used in the step of forming the particles from the pigmented resin composition, is then fixed to a surface of the pigmented resin particles during the formation of toner.

If a polymer dispersing agent with an SP value greater than 10 is used, then the humidity-resistance will be reduced because a residual polymer dispersing agent on a surface of the toner becomes moisture-absorptive. This causes the toner to be able to have an lower electrostatic charging amount and to be less insulative. This gives rise to a problem of fog or a defect in transfer. On the other hand, if a polymer dispersing agent with an SP value less than 8.5 is used, toner cannot be evenly dispersed in a hydrophobic medium. This makes it difficult to obtain a toner that (i) is small in particle size and (ii) exhibits a sharp particle size distribution.

Further, if a polymer dispersing agent with a glass transition point below 50° C., then a residual polymer dispersing agent on a surface of the toner softens a resin on the surface of the toner. This increases adhesiveness of the toner particles, and therefore causes a problem that toners thus prepared aggregate with each other. On the other hand, if the glass transition point of the polymer dispersing agent exceeds 80° C., then (i) it becomes difficult for the polymer dispersing agent to be dissolved into the hydrophobic medium and/or (ii) it becomes difficult for the pigmented resin composition to become particles in the hydrophobic medium. In view of the facts, it is preferable that the suitable glass transition point of the polymer dispersing agent be in a range of 50° C. to 80° C.

The SP value and the glass transition point of the polymer dispersing agent can be controlled by changing (i) the kinds of monomers to be used and/or (ii) a proportion compounding ratio of monomers. A styrene-acrylic copolymer or a derivative of the styrene-acrylic copolymer is suitable, in light of the glass transition point, the SP value, and costs.

The SP value and the glass transition point of the styrene-acrylic base polymer dispersing agent can be adjusted by changing (i) the kinds of styrene based monomers or acrylic monomers and/or (ii) a proportion of monomers in copolymerization.

Examples of the monomer include styrene, vinyltoluene, methyl acrylate, ethyl acrylate, isopropyl acrylate, n-butyl acrylate, isobutyl acrylate, ethylhexyl acrylate, methyl methacrylate, ethyl methacrylate, isopropyl methacrylate, n-butyl methacrylate, isobutyl methacrylate, ethylhexyl methacrylate, acrylic acid, and methacrylic acid.

A polymer dispersing agent having a polar group, such as a hydroxy group, at one end of its macromolecular chain may be used. In this case, the end with the polar group directs toward a center of the toner, and an end without a polar group directs outward (extends into the hydrophobic medium). This prevents an exposure of the polar group of the polymer dispersing agent on a surface of the toner. This allows an improvement in humidity-resistance of the toner.

A polar group can be introduced in an end of a polymer by, for example, polymerizing a vinyl monomer with the use of a polymerization initiator that contains a carboxylic acid group such as an azobiscyanovaleric acid, thereby introducing the carboxylic acid group in the end of the polymer.

Furthermore, by reacting, with an organic compound that contains an epoxy group, the polymer compound to which the carboxylic acid group is introduced, it is possible to introduce a hydroxyl group in the polymer compound.

A comb-shaped polymer dispersing agent that includes a main chain and a side chain may be used as the organic compound containing the epoxy group. The comb-shaped polymer dispersing agent is prepared by (i) synthesizing a macromonomer with a double bond at one end, by way of reaction of (a) the macromolecular compound with the carboxylic acid group and (b) a vinyl compound such as glycidyl methacrylate, and (ii) performing copolymerization with the use of the macromonomer and another vinyl monomer.

Further, a monomer that contains a polar group (such as an acrylic acid with a carboxylic acid group) may be used as the vinyl monomer in order to enhance the polarity of the main chain.

In the polymer dispersing agent, which has a comb-shape branch structure having a main chain and a side chain, the polarity of the main chain is higher than the polarity of the side chain. Therefore, the polymer dispersing agent easily orients such that the main chain of the polymer dispersing agent adhering to a surface of the toner easily directs toward the surface of the toner, whereas the side chain of the polymer dispersing agent directs toward the hydrophobic medium.

As a result, the polymer dispersing agent is prevented from easily separating from the surface of the toner due to a Van der Waals force between the main chain of the polymer dispersing agent and the resin of the toner, or due to entanglement of polymers.

In the present invention, the SP (solubility parameter) value may be measured by following the method of SUH and CLARKE [J. P. S. A-1,5, pp. 1671 to 1681 (1967)] as described below.

In a 100 ml-beaker, 0.5 g of resin to be measured is introduced. Then, 10 ml of good solvent (dioxane, acetone) is added therein by using a whole pipette, and dissolved by using a magnetic stirrer. Thereafter, a hydrophobic solvent (n-hexane, ion exchanged water) is titrated therein at 20° C. by using a 50 ml-burette until a turbidity point is reached.

The SP value δ of the resin is calculated on the basis of the titers measured above by using the formula below:

$$\delta=(V_{ml}^{1/2}\delta_{ml}V_{mh}^{1/2}\delta_{mh})/(V_{ml}^{1/2}+V_{mh}^{1/2})$$

[In the above formula, $V_{ml}$ is a molecular volume (ml/mol) of a solvent in a low-SP solvent mixture system, $V_{mh}$ is a molecular volume (ml/mol) of a solvent in a high-SP solvent mixture system, $\delta_{ml}$ is the SP value of the solvent in the low-SP solvent mixture system, and $\delta_{mh}$ is the SP value of the solvent in the high-SP solvent mixture system.]

Note that:

$$V_m=V_1V_2/(\phi_1V_2+\phi_2V_1)$$

$$\delta_m=\phi_1\delta_1+\delta_2\delta_2$$

[In the above formulae, $V_m$ is a molecular volume (ml/mol) of the solvent mixture, $V_1$ and $V_2$ are the molecular volumes (ml/mol) of the solvents to be used, $\phi_1$ and $\phi_2$ are volume parts per million of the solvents titrated until reaching the turbidity point, $\delta_m$ is the SP value of the solvent mixture, and $\delta_1$ and $\delta_2$ are the SP values of the solvents.]

<Hydrophobic Medium>

In the present invention, a medium with less affinity to a polar group, or with lower polarity, is used as the hydrophobic medium. If a hydrophobic medium that causes the binder resin to be dissolved therein or swelled is used, it becomes difficult to distill off the hydrophobic medium in the step of drying. Therefore, a suitable hydrophobic medium is a hydrocarbon based solvent that does not cause the binder resin to be solved therein or swelled.

Concrete examples are n-hexane, isohexane, cyclohexane, methylcyclohexane, ethylcyclohexane, n-heptane, n-octane, isooctane, ligroin, petroleum benzine, and their mixtures.

It is preferable to use a hydrophobic medium with a boiling point in a range of 60° C. to 180° C., considering convenience of handling in heating or in evaporating for drying.

<External Additive>

A well known external additive may be added to the toner of the present invention, in order to improve flowability or charging property. Examples of generally used external additives include: silica, titanium oxide, aluminum oxide, and inorganic fine particles that are prepared by surface-modifying any of them with a silane coupler, a titanium coupler, or a silicone oil. The generally used external additives have an average particle diameter in a range of 0.007 μm to 0.02 μm. Further, the toner of the present invention has a relatively smooth surface. Therefore, it is preferable to also use a second external additive with an average particle diameter of 0.03 μm or greater, in order to improve transfer property, easiness in cleaning and anti-aggregation property. Examples of the second external additive include: silica; titanium oxide; aluminum oxide; inorganic fine particles that are prepared by surface-modifying the above external additives with a silane coupler, a titanium coupler, or a silicone oil; metal salts of fatty acid; zinc stearate; calcium stearate; lead stearate; zinc oxide powder; and a fluorine based resin fine particles such as fine particles of vinylidene fluoride and fine particles of polytetrafluoroethylene.

It is preferable that the amount of external additive to be added be in a range of 0.3 parts by weight to 3 parts by weight with respect to 100 parts by weight of the main part of the toner. If less than 0.3 parts by weight of external additive is added, then flowability would not improve. On the other hand, if greater than 3 parts by weight of external additive is added, then fusibility decreases.

A fine particulate abrasive may be further added to the toner. Concrete examples of the abrasive include strontium titanate, cerium oxide, silicon carbide, and magnetite. These fine particulates may be treated by using a coupler such as a silane coupler or a titanium coupler, a silicone oil, or other organic compounds. A particle diameter of the abrasives to be used is in a range of 0.04 μm to 2 μm. If an excess amount of abrasive is used, then abrasion is expedited on surfaces of an electrostatic latent image holding member and a developer holding member. Therefore, it is preferable that the amount of the abrasive to be added be 2 parts by weight or less with respect to 100 parts of toner particle.

EXAMPLES

The following describes the Examples to confirm that the object of the present invention is achieved with the use of the toner of the present invention described above. Results of evaluation of the toner obtained by the following Examples (i) confirm that the object of the present invention is achieved, (ii) confirm that unique effects are achieved, and (iii) clarify the main purport of the present invention.

Example 1

<<Step of Producing a Pigmented Resin Composition (S1)>>

One hundred parts of polyester resin (glass transition point (Tg) of 62° C., softening point of 130° C.), 5 parts of coloring agent (carbon black), and 5 parts of wax (polyethylene, melting point of 125° C.) were mixed and dispersed for three minutes by using a Henschel mixer. Thereafter, the mixture was melted, kneaded, and dispersed by using an extruder (product name: "niidikusu" MOS 140-800, manufactured by Mitsui mining Co., Ltd.). As a result, a pigmented resin extrudate was prepared (the product will be referred to as a pigmented resin extrudate).

The softening point was measured under the conditions mentioned below by using a flow-tester CFT-500 (manufactured by Shimadzu corporation). A temperature at a time of ½ stroke was measured as the softening point.

[Conditions of Measurement of Softening Point]

Amount of sample: 1 g
Dimension of die: 1.0×1.0 mm
Load of extrusion: 1960 kPa (20 kgf/cm$^2$)
Temperature elevation rate: 6° C.
Initial temperature: 60° C.
Pre-heating time: 300 seconds <<Step of Producing a Polymer Dispersing Agent (S2)>>

One hundred and fifty parts of "tokusorubento" (petroleum based mixed solvent, manufactured by Shoei Chemical Inc.) was introduced in a reactor vessel that included a stirrer, a thermometer, a nitrogen inlet tube, and a cooling tube. The temperature of the "tokusorubento" was elevated to 120° C. under nitrogen gas flux. A mixture of 55 parts of styrene (ST), 15.0 parts of methylmethacrylate (MMA), 8.37 parts of laurylmethacrylate (LMA), 20 parts of normal butlacrylate (NBA), 2.5 parts of V-50.1 (4-4'azobiscyanovaleric acid, manufactured by Wako pure chemical industries, Ltd.), and 40 parts of "tokusorubento" was dropped into the container over three hours. Then the mixture was maintained at the same temperature for one hour. Thereafter, a solution containing 0.15 parts of V-501 and 10 parts of "tokusorubento" was dropped over 15 minutes, and then maintained at the same temperature for five hours. Thereafter, the temperature was lowered down to 80° C., and 1.63 parts of glycidyl methacrylate and 0.2 parts of 1,8-diazabicyclo[5,4,0]undecene were added therein and reacted therewith for two hours. Then, the mixture was cooled. As a result, a solution of long chain macromonomer containing a radically polymerizable group at an end thereof was obtained.

While the solution was maintained at 95° C., a mixture of 60 parts of styrene (ST), 10 parts of methacrylic acid (MAA), 20 parts of laurylmethacrylate (LMA), 10 parts of normalbutylacrylate (NBA), 1.0 parts of "kayaesuteru O" (t-butylperoxy2-ethylhexanoate, manufactured by Nippon kayaku Co., Ltd.), and 1.0 parts of "tokusorubento" was dropped over three hours. The mixture was then maintained at the same temperature for one hour. Thereafter, a solution containing 0.25 parts of "kayaesuteru O" and 2.33 parts of "tokusorubento" was dropped for 30 minutes. Then, the solution was maintained at the same temperature for 1.5 hours and then cooled. As a result, polymer dispersing agent (P) was obtained. Details of polymer dispersing agent (P) were as follows: nonvolatile content is 50.4%; Mn (number average molecular weight)=4200; Mw (weight average molecular weight)=34000; SP=9.1; and Tg=65° C.

<<Step of Preparing Particles (S3)>>

One hundred parts of polymer dispersing agent solution (P), which had been obtained by the step of producing a polymer dispersing agent (S2), were mixed with 900 parts of Isopar G (manufactured by Exxon Corporation), thereby preparing a 5 wt % polymer dispersing agent solution. Then, 450 parts of the pigmented resin extrudate, which had been prepared in S1, was mixed with 350 parts of acetone, thereby preparing a pigmented resin extrudate solution. Then, (i) 500 parts of the 5 wt % polymer dispersing agent solution and (ii) 400 parts of the pigmented resin extrudate solution were added in a metal container provided with a pressure adjusting valve, heating means, and rotor-stator stirring means (aperture diameter: 30 mm). They were stirred and mixed for 10 minutes (10000 min$^{-1}$ (rpm)), while heated at 85° C. Thereafter, the heating was stopped, and the mixture was cooled to 20° C. under stirred.

<<Step of Removing an Organic Solvent (S4)>>

The mixture was transferred to a recovery flask. Then, the pressure in the recovery flask was reduced to 46.55 kPa (350 mmHg) while the recovery flask was heated to 40° C. by using an evaporator, thereby distilling off acetone.

<<Step of Cleaning, Separating, and Drying (S5)>>

The mixture was cleaned by repeating centrifugation and re-dispersion with the use of Isopar G two times. Finally, the mixture was dried. As a result, toner (A) was obtained. This toner (A) was observed with the use of a scanning electron microscope (SEM). Only toner that was spherical with smooth surface was found, but no coarse particles formed of a plurality of particles adhering to each other and forming an aggregate was found. Further, the volume average particle diameter and the coefficient of variation of toner (A) were measured with the use of a Coulter Multisizer II (manufactured by Beckman Coulter, Inc.) whose aperture was set at 100 μm. Results of the measurement were: volume average particle diameter was 6.4 μm; coefficient of variation was 22; and degree of roundness was 0.99.

<<Step of Adhering an External Additive to the Particles (S6)>>

To 100 parts of toner (A), which had been obtained in the preceding step, 0.7 parts of silica particles were added by using a Henschel mixer, which silica particles had been made into hydrophobic with the use of a silane coupler having a average primary particle diameter of 20 nm. As a result, external additive-added toner (T-1) was obtained.

<Preparation of Developer>

This external additive-added toner (T-1) was mixed with ferrite carrier with the use of a ball mill, which ferrite carrier had the average particle diameter of 50 μm and was silicon-coated. As a result, two-component developer (D-1) with the toner density of 7% was prepared.

Example 2

Polymer dispersing agent solution (Q) was prepared by the method described below, in place of polymer dispersing agent solution (P) used in Example 1.

A long chain macromonomer solution was prepared by following the same method as in Example 1. While the long chain macromonomer was maintained at 95° C., a mixture of 60 parts of styrene (ST), 10 parts of methacrylic acid (MAA), 3 parts of normalbutylacrylate (NBA), 17 parts of laurylmethacrylate (LMA), 10 parts of hydroxyethylmethacrylate (HEMA), 1.0 parts of "kayaesuteru O" (t-butylperoxy2-ethylhexanoate, manufactured by Nippon kayaku Co., Ltd.), and 1.0 parts of "tokusorubento" was dropped over three hours. Then, this was maintained at the same temperature for one hour. Thereafter, a solution containing 0.25 parts of "kayaesuteru O" and 2.33 parts of "tokusorubento" was dropped over 30 minutes. This was maintained at the same temperature for 1.5 hours, and then cooled. As a result, polymer dispersing agent solution (Q) was obtained. Details of polymer dispersing agent solution (Q) were as follows: Mn=3500; Mw=31000; SP=9.8; and Tg=69° C.

Toner of Example 2 was produced with the use of polymer dispersing agent solution (Q), by following the same method as in Example 1. This toner (B) was observed with the use of a scanning electron microscope (SEM). Only toner that was spherical with smooth surface was found, but no coarse particles formed of a plurality of particles adhering to each other and forming an aggregate was found. Further, the same measurement as in Example 1 was performed, and the results thereof were: volume average particle diameter was 6.3 μm; coefficient of variation was 23; and degree of roundness was 0.98.

External additive-added toner (T-2) and developer (D-2) were produced with the use of toner (B) by following the same method as in Example 1.

Example 3

Polymer dispersing agent solution (R) was prepared by the method below, in place of polymer dispersing agent solution (P) used in Example 1.

A long chain macromonomer solution was prepared by following the same method as in Example 1. While the long chain macromonomer solution was maintained at 95° C., a mixture of 60 parts of styrene (ST), 10 parts of methacrylic acid (MAA), 30 parts of laurylmethacrylate (LMA), 1.0 parts of "kayaesuteru O" (t-butylperoxy2-ethylhexanoate, manufacture by Nippon kayaku Co., Ltd.), and 1.0 parts of "tokusorubento" was dropped over three hours. Then, this was maintained at the same temperature for one hour. Thereafter, a solution containing 0.25 parts of "kayaesuteru O" and 2.33 parts of "tokusorubento" was dropped over 30 minutes. Then, this was maintained at the same temperature for 1.5 hours, and then cooled. As a result, polymer dispersing agent solution (R) was obtained. Details of polymer dispersing agent solution (R) were as follows: Mn=3300; Mw=30000; SP=8.7; and Tg=62° C.

Toner (C) of Example 3 was produced with the use of polymer dispersing agent solution (R) by following the same method as in Example 1. When this toner (C) was observed with the use of a scanning electron microscope (SEM), only toner that was spherical with smooth surface was found, but no coarse particles formed of a plurality of particles adhering to each other and forming an aggregate was found. Further, the volume average particle diameter and the coefficient of variation of toner (C) were measured in the same manner as in Example 1. Results of the measurement were: volume average particle diameter was 6.5 μm; coefficient of variation was 24; and degree of roundness was 0.99.

External additive-added toner (T-3) and developer (D-3) were produced with the use of toner (C) by following the same method as in Example 1.

Example 4

Polymer dispersing agent solution (S) was prepared by the method described below, in place of polymer dispersing agent solution (P) used in Example 1.

A long chain macromonomer solution was prepared by following the same method as in Example 1. While the long chain macromonomer solution was maintained at 95° C., a mixture of 45 parts of styrene (ST), 10 parts of methacrylic acid (MAA), 10 parts of normalbutylacrylate (NBA), 32 parts of laurylmethacrylate (LMA), 3 parts of hydroxyethylmethacrylate (HEMA), 1.0 parts of "kayaesuteru O" (t-butylperoxy2-ethylhexanoate, manufactured by Nippon kayaku Co., Ltd.), and 1.0 parts of "tokusorubento" was dropped over three hours. Then, this was maintained at the same temperature for one hour. Thereafter, a solution containing 0.25 parts of "kayaesuteru O" and 2.33 parts of "tokusorubento" was dropped over 30 minutes. This was maintained at the same temperature for 1.5 hours, and then cooled. As a result, polymer dispersion agent solution (S) was obtained. Details of polymer dispersion agent solution (S) were as follows: Mn=3500; Mw=31000; SP=9.2; and Tg=53° C.

Toner (D) of Example 4 was prepared with the use of polymer dispersing agent solution (S) by following the same method as in Example 1. When this toner (D) was observed with the use of a scanning electron microscope (SEM), only toner that was spherical with smooth surface was found, but no coarse particles formed of a plurality of particles adhering to each other and forming an aggregate was found. Further, the volume average particle diameter and the coefficient of variation of toner (D) were measured in the same manner as in Example 1. Results of the measurement were: volume average particle diameter was 6.3 μm; coefficient of variation was 23; and degree of roundness was 0.98.

External additive-added toner (T-4) and developer (D-4) were produced with the use of toner (D) by following the same method as in Example 1.

Example 5

Polymer dispersing agent solution (T) was prepared by the method described below, in place of polymer dispersing agent solution (P) used in Example 1.

A long chain macromonomer solution was prepared by following the same method as in Example 1. While the long chain macromonomer solution was maintained at 95° C., a mixture of 60 parts of styrene (ST), 10 parts of methacrylic acid (MAA), 23 parts of normalbutylacrylate (NBA), 7 parts of methylmethacrylate (MMA), 1.0 parts of "kayaesuteru O" (t-butylperoxy2 -ethylhexanoate, manufactured by Nippon kayaku Co., Ltd.), and 1.0 parts "tokusorubento" was dropped over three hours. Then, this was maintained at the same temperature for one hour. Thereafter, a solution containing 0.25 parts of "kayaesuteru O" and 2.33 parts of "tokusorubento" was dropped over 30 minutes. Then, this was maintained at the same temperature for 1.5 hours, and then cooled. As a result, polymer dispersing agent solution (T) was obtained. Details of polymer dispersing agent solution (T) were as follows: Mn=4500; Mw=34000; SP=9.4; and Tg=76° C.

Toner (E) of Example 5 was produced with the use of polymer dispersing agent solution (T) by following the same method as in Example 1. When this toner (E) was observed with the use of a scanning electron microscope (SEM), only toner that was spherical with smooth surface was found, but no coarse particle formed of a plurality of particles adhering to each other and forming an aggregate was found. Further, the volume average particle diameter and the coefficient of variation of toner (E) were measured in the same manner as in Example 1. Results of the measurement were: volume average particle diameter was 6.3 μm; coefficient of variation was 23; and degree of roundness was 0.98.

External additive-added toner (T-5) and developer (D-5) were produced with the use of toner (E) by following the same method as in Example 1.

Comparative Example 1

Polymer dispersing agent solution (V) was prepared by the method described below, in place of polymer dispersing agent solution (P) used in Example 1.

One hundred and fifty parts of "tokusorubento" (petroleum base mixed solvent, manufactured by Shoei Chemical Inc.) was charged in a reactor container that included a stirrer, a thermometer, a nitrogen inlet tube, and a cooling tube, and the temperature was elevated to 120° C. under nitrogen gas flux. A mixture of 50 parts of styrene (ST), 15.0 parts of methylmethacrylate (MMA), 8.37 parts of laurylmethacrylate (LMA), 25 parts of normalbutylacrylate (NBA), 2.5 parts of V-501 (4-4'azobiscyanovaleric acid, manufactured by Wako pure chemical industries, Ltd.), and 40 parts of "tokusorubento" was dropped into the container over three hours. Then, this was maintained at the same temperature for one hour. Thereafter, a solution containing 0.15 parts of V-501 and 10 parts of "tokusorubento" was dropped over 15 minutes. Then, this was maintained at the same temperature for 5 hours. Thereafter, the temperature was lowered to 80° C., and then 1.63 parts of glycidyl methacrylate and 0.2 parts of 1,8-diazabicyclo[5,4,0]undecene were added to react for 2 hours. This was then cooled. As a result, a solution of a long chain macromonomer containing a radically polymerizable group at an end thereof was obtained.

While the solution was maintained at 95° C., a mixture of 50 parts of styrene (ST), 10 parts of methacrylic acid (MAA), 10 parts of laurylmethacrylate (LMA), 5 parts of normalbutylacrylate (NBA), 10 parts of hydroxyethylmethacrylate (HEMA), 15 parts of methoxytriethylene glycolacrylate, 1.0 parts of "kayaesuteru O" (t-butylperoxy2-ethylhexanoate, manufactured by Nippon kayaku Co., Ltd.), and 1.0 parts of "tokusorubento" was dropped over three hours. Then, this was maintained at the same temperature for one hour. Thereafter, a solution containing 0.25 parts of "kayaesuteru O" and 2.33 parts of "tokusorubento" was dropped over 30 minutes. Then, this was maintained at the same temperature for 1.5 hours, and then cooled. As a result, polymer dispersing agent solution (V) was obtained. Details of polymer dispersing agent solution (V) were as follows: Mn=4600; Mw=36000; SP=10.6; and Tg=58° C.

Toner (F) of Comparative Example 1 was produced with the use of polymer dispersing agent solution (V) by following the same method as in Example 1. When this toner (F) was observed with the use of a scanning electron microscope (SEM), only toner that was spherical with smooth surface was found, but no coarse particle formed of a plurality of particles adhering to each other and forming an aggregate was found. Further, the volume average particle diameter and the coefficient of variation of toner (F) were measured in the same manner as in Example 1. Results of the measurement were: volume average particle diameter was 6.2 μm; coefficient of variation was 23; and degree of roundness was 0.97.

External additive-added toner (T-6) and developer (D-6) were produced with the use of toner (F) by following the same method as in Example 1.

Comparative Example 2

Polymer dispersing agent solution (W) was prepared by the method described below, in place of polymer dispersing agent solution (P) used in Example 1.

One hundred and fifty parts of "tokusorubento" (petroleum base mixed solvent, manufactured by Shoei Chemical Inc.) was charged in a reactor container that included a stirrer, a thermometer, a nitrogen inlet tube, and a cooling tube, and the temperature was elevated to 120° C. under nitrogen gas flux. Then, a mixture of 60 parts of styrene (ST), 30 parts of laurylmethacrylate (LMA), 8.37 parts of normalbutylacrylate (NBA), 2.5 parts of V-501 (4-4'azobiscyanovaleric acid, manufactured by Wako pure chemical industries, Ltd.), and 40 parts of "tokusorubento" was dropped for three hours. Then, this was maintained at the same temperature for one hour. Thereafter, a solution containing 0.15 parts of V-501 and 10 parts of "tokusorubento" was dropped for 15 minutes. Then, this was maintained at the same temperature for 5 hours. Thereafter, the temperature was lowered to 80° C., and then 1.63 parts of glycidyl methacrylate and 0.2 parts of 1,8-diazabicyclo[5,4,0]undecene were added to react for two hours. This was then cooled. As a result, a solution of a long chain macromonomer containing a radically polymerizable group at an end of thereof was obtained.

While the solution was maintained at 95° C., a mixture of 70 parts of styrene (ST), 30 parts of normalbutylacrylate (NBA), 1.0 parts of "kayaesuteru O" (t-butylperoxy2-ethylhexanoate, manufactured by Nippon kayaku Co., Ltd.), and 1.0 parts of "tokusorubento" was dropped over three hours. Then, this was maintained at the same temperature for one hour. Thereafter, a solution containing 0.25 parts of "kayaesuteru O" and 2.33 parts of "tokusorubento" was dropped over 30 minutes. Then, this was maintained at the same temperature for 1.5 hours, and then cooled. As a result, polymer dispersing agent solution (W) was obtained. Details of polymer dispersing agent solution (W) were as follows: Mn=4500; Mw=40000; SP=8.3; and Tg=57° C.

Toner (G) of Comparative Example 2 was produced with the use of polymer dispersing agent solution (W) by following the same method as in Example 1. Toner (G) had the volume average particle diameter of 12.5 μm and the coefficient of variation of 98. Because granularity thereof was extremely inferior, evaluation of image was not carried out.

Comparative Example 3

Polymer dispersing agent solution (X) was prepared by the method described below, in place of polymer dispersing agent solution (P) used in Example 1.

A long chain macromonomer solution was prepared by following the same method as in Example 1. While the long chain macromonomer solution was maintained at 95° C., a mixture of 50 parts of styrene (ST), 10 parts of methacrylic acid (MAA), 40 parts of isobornylmethacrylate (IBMA), 1.0 parts of "kayaesuteru O" (t-butylperoxy2-ethylhexanoate, manufactured by Nippon kayaku Co., Ltd.), and 1.0 parts of "tokusorubento" was dropped over three hours. Then, this was maintained at the same temperature for one hour. Thereafter, a solution containing 0.25 parts of "kayaesuteru O" and 2.33 parts of "tokusorubento" was dropped over 30 minutes. Then, this was maintained at the same temperature for 1.5 hours, and then cooled. As a result, polymer dispersing agent solution (X) was obtained. Details of dispersing agent solution (X) were as follows: Mn=3700; Mw=35000; SP=9.2; and Tg=85° C.

Toner (H) of Comparative Example 3 was produced with the use of polymer dispersing agent solution (X) by following the same method as in Example 1. Toner (H) had a volume average particle diameter of 14.8 μm and a coefficient of variation of 79. Because granularity thereof was extremely inferior, evaluation of image was not carried out.

Comparative Example 4

Polymer dispersing agent solution (Y) was prepared by the method described below, in place of polymer dispersing agent solution (P) used in Example 1.

A long chain macromonomer solution was prepared by following the same method as in Example 1. While the long chain macromonomer solution was maintained at 95° C., a mixture of 42 parts of styrene (ST), 5 parts of methacrylic acid (MAA), 48 parts of laurylmethacrylate (LMA), 5 parts of hydroxyethylmethacrylate (HEMA), 1.0 parts of "kayaesuteru O" (t-butylperoxy2-ethylhexanoate, manufactured by Nippon kayaku Co., Ltd.), and 1.0 parts of "tokusorubento" was dropped over three hours. Then, this was maintained at the same temperature for one hour. Thereafter, a solution containing 0.25 parts of "kayaesuteru O" and 2.33 parts of "tokusorubento" was dropped over 30 minutes. Then, this was maintained at the same temperature for 1.5 hours, and then cooled. As a result, polymer dispersing agent solution (Y) was obtained. Details of polymer dispersing agent solution (Y) were as follows: Mn=4800; Mw=37000; SP=9.0; and Tg=44° C.

Toner (I) of Example 4 was produced with the use of polymer dispersing agent solution (Y) by following the same method as in Example 1. When this toner (I) was observed with the use of a scanning electron microscope (SEM), only toner that was spherical with smooth surface was found, but no coarse particle formed of a plurality of particles adhering to each other and forming an aggregate was observed. Further, the volume average particle diameter and the coefficient of variation of toner (I) were measured in the same manner as in Example 1. Results of the measurement were: volume average particle diameter was 6.2 μm; coefficient of variation was 23; and degree of roundness was 0.97.

External additive-added toner (T-9) and developer (D-9) were produced with the use of toner (I) by following the same method as in Example 1.

<Results of Evaluation>

(Evaluation of Humidity-Resistance)

Evaluation of humidity-resistance was conducted with respect to the developers of the respective Examples and Comparative Examples described above. Items of evaluation include (i) image quality under a condition of high temperature and high humidity (35° C., humidity: 80%) and (ii) image quality under a condition of low temperature and low humidity (10° C., humidity: 25%).

A modified digital full-color MFP (AR-C 150, manufactured by Sharp Kabushiki Kaisha) was used in the evaluation. The respective developers were evaluated under a condition where (i) the temperature and the humidity are ambient (20° C., humidity: 60%) and (ii) the amount of toner adhering to a solid part of the image on a photoreceptor drum was 0.5 mg/cm$^2$.

An image density under (i) a condition of high temperature and high humidity (HH) and (ii) a condition of low temperature and low humidity (LL), and a fog density were measured as the items of evaluation of image quality. If the image density was 1.4 or greater and the fog density was 1.0 or below, then the developer was evaluated as "GOOD". If either one of the image density and the fog density fails to fall into the above range, then the developer was evaluated as "POOR".

The image density was measured by using a color reflection spectrodensitometer (X-Rite938, manufactured by Nippon lithograph, Inc.). The fog density was measured by using a whiteness checker (Z-Σ90 COLOR MEASURING SYSTEM, manufactured by Nippon denshoku industries Co., Ltd.). The image density and the fog density were calculated by the steps below.

A degree of whiteness of the A4-size (297 mm×210 mm) sheet for full-color printing (PP106A4C, manufactured by Sharp Kabushiki Kaisha) was measured in advance, and the measured value was a first measured value W1. Then, three copies of a document containing a white circle with a diameter of 55 mm was made. The degree of whiteness of the white part thereof was measured by using the whiteness checker, and the measure value was a second measured value W2. The fog density W(%) was calculated according to the formula below:

$$W=100\times(W1-W2).$$

(Evaluation of Toner Aggregability)

Evaluation was made on toner aggregability of the respective toners produced in the above Examples and Comparative Examples. Before evaluation, samples for the evaluation were subjected to such a heat treatment that a 50-milliliter glass bottle containing 10 g of toner for evaluation was kept in a constant temperature bath at 50° C. (this temperature is the maximum temperature expected during shipment of the toner) and left therein for 48 hours. The respective sample toners were let stand at an ambient temperature (20° C.) for two hours to be cooled down, and then sieved with a 100-mesh sieve. Then, the state of the residual toner on the mesh filter was observed and evaluated according to the following categories:

GOOD: no toner aggregate remained on the sieve

POOR: toner aggregate remained on the sieve.

TABLE 1

| EXAMPLES | SP VALUE | GLASS TRANSITION POINT (° C.) | GRANULARITY | AGGREGABILITY OF TONER | HUMIDITY-RESISTANCE INDEPENDENCY |
|---|---|---|---|---|---|
| EXAMPLE 1 | 9.1 | 65 | GOOD | GOOD | GOOD |
| EXAMPLE 2 | 9.8 | 69 | GOOD | GOOD | GOOD |
| EXAMPLE 3 | 8.7 | 62 | GOOD | GOOD | GOOD |
| EXAMPLE 4 | 9.2 | 53 | GOOD | GOOD | GOOD |
| EXAMPLE 5 | 9.4 | 76 | GOOD | GOOD | GOOD |
| COMPARATIVE EXAMPLE 1 | 10.6 | 58 | GOOD | GOOD | POOR |
| COMPARATIVE EXAMPLE 2 | 8.3 | 57 | POOR | — | — |
| COMPARATIVE EXAMPLE 3 | 9.2 | 85 | POOR | — | — |
| COMPARATIVE EXAMPLE 4 | 9.0 | 44 | GOOD | POOR | GOOD |

It is apparent from the evaluation results shown in Table 1 that the toners obtained in Examples 1 to 5 were fine in image quality under the both conditions of (i) high temperature and high humidity (HH) and (ii) low temperature and low humidity (LL). Further, a fine image was obtained with the toners obtained in Examples 1 to 5 without causing a blocking or toner aggregation, even after a continuous copying of 10000 sheets was conducted.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A method of producing toner, comprising the steps of:

(i) forming particles of a pigmented resin by applying shear stress to a mixture of a pigmented resin composition, an organic solvent, a polymer dispersing agent, and a hydrophobic medium, the organic solvent being capable of reducing viscosity of the pigmented resin composition, and said polymer dispersing agent having a glass transition point in a range of 50° C. to 80° C. and an SP value in a range of 8.5 to 10; and (ii) distilling off the organic solvent.

2. The method as set forth in claim 1, wherein said polymer dispersing agent is a comb-shaped polymer dispersing agent having a hydroxy group on a part of a side chain which is in the vicinity of a main chain.

3. The method as set forth in claim 2, wherein said polymer dispersing agent is obtained by copolymerization of a styrene based monomer, an acrylic acid based monomer, and a methacrylic acid based monomer, said polymer dispersing agent being a comb-shaped polymer that has a hydroxyl group on a part of a side chain.

4. The method as set forth in claim 3, wherein said copolymerization includes reacting (i) a styrene-acrylic copolymer having a carboxylic acid group at an end with (ii) glycidyl methacrylate.

5. The method as set forth in claim 1, wherein said hydrophobic medium is a hydrocarbon based solvent.

6. The method as set forth in claim 1, wherein the SP value is in a range of 8.7 to 9.8.

7. The method as set forth in claim 1, wherein the glass transition point is in a range of 53° C. to 76° C.

8. The method as set forth in claim 1, wherein said polymer dispersing agent contains styrene-acrylic copolymer or a derivative of styrene-acrylic copolymer.

9. The method as set forth in claim 1, wherein said polymer dispersing agent has a polar group at one end of its polymer chain.

* * * * *